United States Patent [19]

Rees

[11] Patent Number: 4,721,170

[45] Date of Patent: Jan. 26, 1988

[54] FASTENER DRIVING TOOL

[75] Inventor: Jeffrey P. Rees, Aurora, Ill.

[73] Assignee: Duo-Fast Corporation, Franklin Park, Ill.

[21] Appl. No.: 774,543

[22] Filed: Sep. 10, 1985

[51] Int. Cl.[4] ..... B25C 1/06

[52] U.S. Cl. ..... 173/13; 173/121; 173/124; 227/8; 227/147

[58] Field of Search ..... 173/13, 121, 122–124, 173/139; 227/131, 133, 134, 8; 474/115, 138

[56] References Cited

U.S. PATENT DOCUMENTS

| | | | |
|---|---|---|---|
| 4,042,036 | 8/1977 | Smith et al. | 227/131 X |
| 4,121,745 | 10/1978 | Smith et al. | 227/131 X |
| 4,298,072 | 11/1981 | Baker et al. | 173/13 |
| 4,323,127 | 4/1982 | Cunningham | 173/121 X |
| 4,544,090 | 10/1985 | Warman et al. | 227/131 |
| 4,566,689 | 1/1986 | Ogden | 474/115 X |

FOREIGN PATENT DOCUMENTS

| | | | |
|---|---|---|---|
| 0136477 | 10/1979 | Japan | 227/131 |

*Primary Examiner*—E. R. Kazenske
*Assistant Examiner*—James L. Wolfe
*Attorney, Agent, or Firm*—Mason, Kolehmainen, Rathburn & Wyss

[57] ABSTRACT

A fastener driving tool is provided which employs a drive housing subassembly, preferably in the form of opposed cast metal housing sections, which encloses the flywheel and suitable bearings for rotating the same at high speed. This subassembly also supports the associated idler wheel positioned on the other side of the fastener driving ram from the flywheel and mounts a toggle mechanism for adjusting the idler wheel from an inoperative position, in which the idler is spaced a substantial distance away from the ram, to an operative position close to the ram in response to movement of the tool into engagement with a workpiece. The drive housing subassembly also provides a top opening recess or well which is adapted to receive and position a removable cartridge which includes the ram and an elastic cord return mechanism, this subassembly also defining a vertically extending slot communicating with said recess which is adapted to receive the vertically positioned ram between the opposed flywheel and idler. A plastic housing is provided to enclose the fastener driving ram and the subassembly with its supported components. However, the plastic housing is connected to the subassembly in such manner that impact forces resulting from engagement of the flywheel with the ram are absorbed primarily by the metal drive housing subassembly and are not transmitted to the plastic housing and components carried thereby. As a result, the plastic housing is used to position the tool at a desired location relative to a workpiece but the impact forces and stresses developed during driving of the fastener are effectively isolated from the plastic housing and its components to provide substantially longer life for the fastener driving tool.

43 Claims, 10 Drawing Figures

10
12a
12
22
220
218
220
290
286
202
200
204
288
284
207
206
208
254
266
272
270
42
16
268
264
260
266
256
280
282
94
190
90
192
96
44
112
40
110
54
114
108
116
100
104
102
106
56
64
62
52
50
70
72
46
68
28
244
122
120
130
150
14
242
241
240
226
216
258
262
212
214
210
186
166
168
166
66
18
20
232
234
236
238
4
4

FASTENER DRIVING TOOL

BACKGROUND OF THE INVENTION

1. Field of the Invention

This invention relates generally to fastener driving tools, and particularly to driving tools that utilize an energy storing flywheel that selectively engages a ram in order to drive the ram into engagement with a fastener, such as a nail or a staple, in order to drive the fastener into a workpiece.

2. Description of the Prior Art

Several fastener driving tools that utilize an energy storing flywheel for the purpose of storing energy to drive the fastener into the workpiece are known. Examples of representative prior art devices are disclosed in U.S. Pat. Nos. 4,042,036; 4,121,745; 4,129,240; 4,189,080; 4,298,072; 4,290,493 and 4,323,127. Also, the copending Kerrigan application Ser. No. 476,321, filed Mar. 17, 1983 and assigned to the same assignee as the present invention, discloses a fastener driving tool wherein an energy storing flywheel cooperates with an idler wheel to selectively engage the ram and drive a fastener into the workpiece. The present invention is directed to an improved fastener driving tool of the general type disclosed in said copending Kerrigan application.

In the Kerrigan application, the flywheel, which is rotated at high speed, and the idler wheel which cooperates with the flywheel, are both rotatably mounted in a plastic housing which also supports the control switches, solenoid for controlling engagement of the ram with the flywheel, and the other components of the fastener driving tool. As a result, the impact forces generated during driving of the ram are transmitted directly to these other components of the fastener driving tool which may result in excessive wear on certain components and require substantial repair to maintain the tool in service. Additionally, it has been found that if the idler wheel is too close to the flywheel excessive wear on the ram will result which will substantially shorten the life of the ram and require its replacement. On the other hand, if the idler wheel is too far from the flywheel insufficient force will be imparted to the ram to enable it to drive a particular fastener to the required depth in the workpiece. Accordingly, it would be desirable to provide a readily accessible adjustment of the separation between the idler wheel and the flywheel so that optimum driving conditions can be achieved and maintained. However, such optimum conditions, once achieved, should be maintained despite the impact forces developed while driving a fastener, until the next separation adjustment is required to accommodate a different workpiece or the like. The Kerrigan application provides an eccentric member to adjust the separation between the idler wheel and the flywheel. Such adjustment is, however, not readily accessible and requires special tools to effect the adjustment.

It has also been found that in a device of the type shown in the Kerrigan application the drive belt, which interconnects the flywheel with an electric motor and drives the wheel at high speed, absorbs substantial shock when the high speed flywheel engages the ram and requires an optimum tension to maintain optimum driving conditions for the flywheel. If, for example, the drive belt is replaced, it may be installed with too great a tension which will result in excessive wear and short life of the drive belt. On the other hand, the drive belt absorbs substantial shock when the flywheel engages the ram and may tend to loosen with usage. If the tension in the drive belt becomes too small, then optimum driving conditions for the flywheel are not provided. Accordingly, it would be desirable to provide means for automatically establishing the optimum value of tension in the drive belt.

SUMMARY OF THE INVENTION

Accordingly, it is the object of the present invention to provide a fastener driving tool that overcomes many of the disadvantages of the prior art fastener driving tools.

It is another object of the present invention to provide a new and improved fastener driving tool of the type disclosed in the above-identified Kerrigan application, which is of simplified construction, is reliable in operation and may be used for prolonged periods of time without failure, and can be manufactured at relatively low cost on a mass production basis.

It is another object of the present invention to provide a new and improved fastener driving tool of the type having a ram engageable by an engergy storing electrically driven flywheel to drive a fastener, wherein a cast metal drive housing subassembly is provided to support and enclose the high speed flywheel and support the associated ram and a plastic housing is provided to enclose the ram and subassembly, said housing being connected to the subassembly in such manner that impact forces resulting from engagement of the flywheel with the ram are absorbed primarily by said drive housing subassembly.

It is a further object of the present invention to provide a new and improved fastener driving tool of said type in which said plastic housing comprises opposed housing sections and said subassembly is secured to said plastic housing sections at points spaced on opposite sides of the axis of the flywheel.

It is yet another object of the present invention to provide a new and improved fastener driving tool of said type in which said subassembly provides an integral mounting for a rotatable idler wheel which cooperates with the flywheel in driving the ram.

It is yet another object of the present invention to provide a new and improved fastener driving tool of said type in which a toggle mechanism which moves the idler wheel relative to the flywheel is also mounted on said subassembly.

It is yet another object of the present invention to provide a new and improved fastener driving tool of said type in which said toggle mechanism is actuated in response to engagement of the tool with a workpiece.

It is yet another object of the present invention to provide a new and improved fastener driving tool of said type in which said toggle mechanism includes a lever rotatably mounted on said subassembly which is actuated by a vertically extending linkage connected to said lever when the tool engages a workpiece.

It is another object of the present invention to provide a new and improved fastener driving tool of the type having a flywheel, an electric motor for driving said flywheel and fastener driving means adapted to be driven by said flywheel, which includes a first switch for energizing said motor, a second switch for energizing a solenoid which controls coupling of the flywheel to the fastener driving means, and trigger means for sequentially actuating said first switch means and then actuating said second switch means while said first switch means remains actuated.

It is yet another object of the present invention to provide a new and improved fastener driving tool of said type in which said trigger means is sequentially movable to first and second positions in which said first switch means and said first and second switch means are actuated, respectively.

It is another object of the present invention to provide a new and improved fastener driving tool of said type in which a third switch is connected in series with said second switch means and is closed in response to engagement of the tool with a workpiece.

It is another object of the present invention to provide a new and improved fastener driving tool of the type which includes a flywheel, fastener driving means driven by said flywheel, and an electric motor spaced from said flywheel and connected thereto by a flexible belt, wherein means are provided for automatically establishing a tension of predetermined value in said belt.

It is yet another object of the present invention to provide a new and improved fastener driving tool of said type in which the base of said electric motor is movably mounted on a support structure and is spring biased in the direction to increase the tension in said belt.

It is yet another object of the present invention to provide a new and improved fastener driving tool of said type in which said electric motor may be releasably secured to said support after tension of said predetermined value has been established in said belt by said spring biasing means.

It is another object of the present invention to provide a new and improved fastener driving tool of the type in which an energy storing flywheel and cooperating idler wheel are positioned on opposite sides of a fastener driving ram, said ram, flywheel and idler being enclosed in a plastic housing, and means accessible from the exterior of said housing for adjusting the spacing between said idler and said flywheel.

It is yet another object of the present invention to provide a new and improved fastener driving tool of said type in which said idler adjusting means includes a pawl and ratchet drive arrangement for holding said idler wheel in a desired position.

It is yet another object of the present invention to provide a new and improved fastener driving tool of said type in which said idler adjusting means includes a shaft extending outwardly through an opening in said housing and shaft detent means are provided for holding said shaft in an adjusted position.

Briefly considered, the preferred embodiment of the present invention provides a fastener driving tool which employs a drive housing subassembly, preferably in the form of opposed cast metal housing sections, which encloses the flywheel and suitable bearings for rotating the same at high speed. This subassembly also supports the associated idler wheel positioned on the other side of the fastener driving ram from the flywheel and mounts a toggle mechanism for adjusting the idler wheel from an inoperative position, in which the idler is spaced a substantial distance away from the ram, to an operative position close to the ram in response to movement of the tool into engagement with a workpiece. The drive housing subassembly also provides a top opening recess or well which is adapted to receive and position a removable cartridge which includes the ram and an elastic cord return mechanism, this subassembly also defining a vertically extending slot communicating with said recess which is adapted to receive the vertically positioned ram between the opposed flywheel and idler.

A plastic housing is provided to enclose the fastener driving ram and the subassembly with its supported components. However, the plastic housing is connected to the subassembly in such manner that impact forces resulting from engagement of the flywheel with the ram are absorbed primarily by the metal drive housing subassembly and are not transmitted to the plastic housing and components carried thereby. As a result, the plastic housing is used to position the tool at a desired location relative to a workpiece but the impact forces and stresses developed during driving of the fastener are effectively isolated from the plastic housing and its components to provide substantially longer life for the fastener driving tool.

Preferably the removable cartridge is of simplified low cost construction so that it may be removed as a unit and replaced by a similar cartridge rather than replacing the fastener driving ram alone. Also, the plastic housing is provided with an opening above the replaceable cartridge which is closed by a slidable cover which may be withdrawn sufficiently to permit removal of the cartridge, the cover being prevented from being completely removed from the plastic housing so that it will not be lost.

An electric motor for driving the flywheel is spaced from the flywheel in the plastic housing and is connected to the flywheel by means of a flexible belt, there being provided automatic tensioning means for establishing an optimum value of tension in the belt to provide optimum conditions for driving the fastener driving ram. More particularly, the base of the electric motor is slidably mounted in the plastic housing and spring biasing means are provided for urging the electric motor base in the direction to increase the tension in the belt, said spring biasing means providing an optimum tension in the belt which can be maintained thereafter by locking the movable base of the motor to the plastic housing. Preferably, the drive belt and associated pulleys on the flywheel shaft and electric motor shaft are completely enclosed within the plastic housing and a removable panel is provided to provide access to the screws which secure the movable base of the electric motor to the housing. In addition, a removable panel is provided in the plastic housing in the vincinity of the idler wheel to permit the removal and replacement of the idler wheel when required.

DESCRIPTION OF THE DRAWINGS

These and other objects and advantages of the present invention will become apparent upon consideration of the following detailed description and the attached drawings wherein:

FIG. 6 is a front elevation, partly in section, of the replaceable cartridge of the present invention;

DETAILED DESCRIPTION OF THE PREFERRED EMBODIMENT

Figure 1:
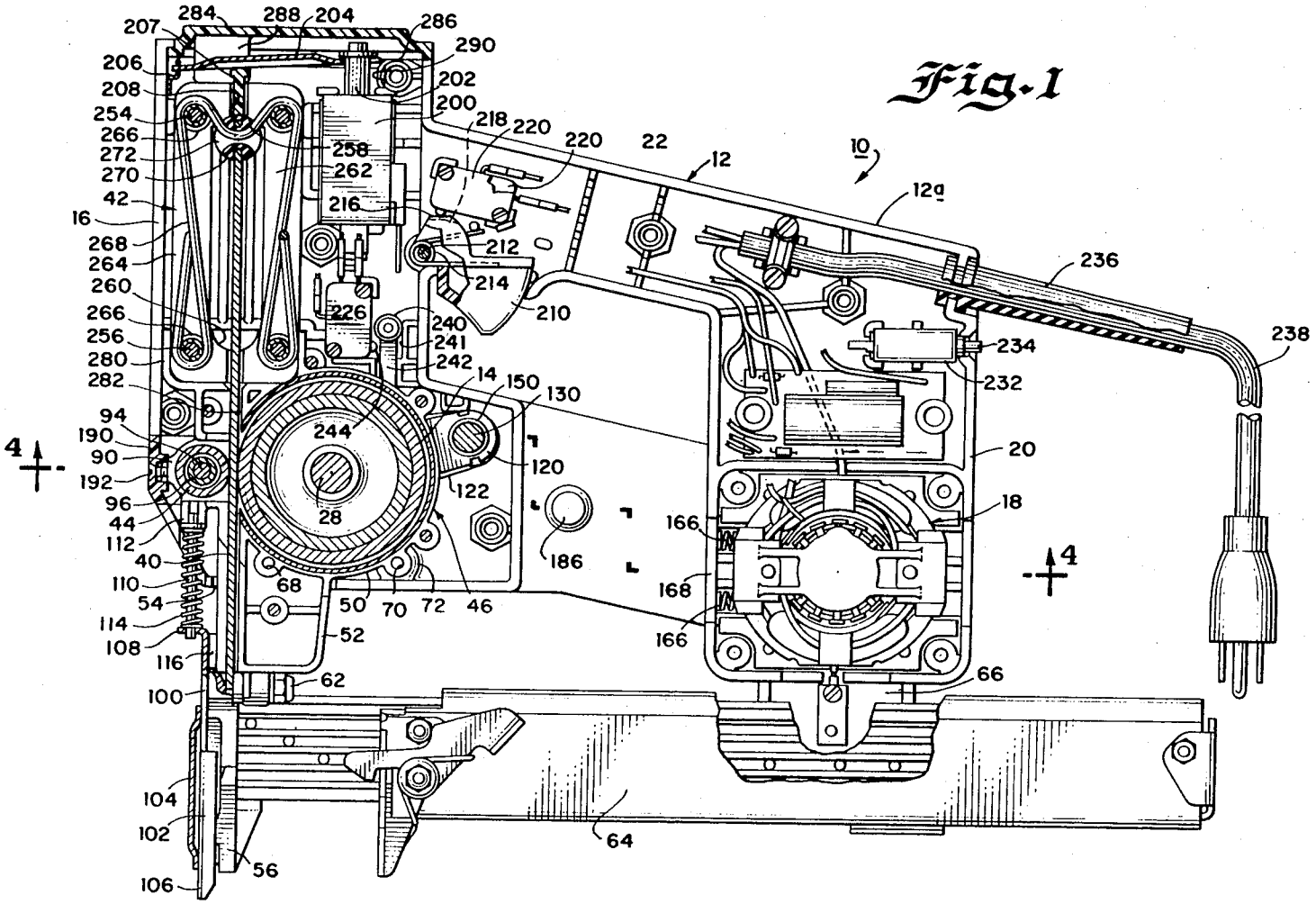
FIG. 1 is a right side elevation of the fastener driving tool of the present invention taken through the longitudinal center line of the tool and shown with the right hand section of the plastic housing removed.

Referring now to the drawings, with particular attention to FIG. 1, there is shown a fastener driving tool according to the present invention generally designated by the reference numeral 10. The fastener driving tool 10 includes a housing 12 which comprises a left hand housing section 12*a*, shown in FIG. 1, on which the operating components of the fastener driving tool are mounted, and a right hand housing section 12*b* (FIG. 2) which cooperates with the housing section 12*a* to provide a completely enclosed fastener driving tool. A flywheel 14 is rotatably mounted within the forward vertically extending portion 16 of the housing section 12*a* and an electric motor indicated generally at 18 is mounted in a vertically extending rear portion 20 of the housing section 12*a*, the intermediate portion 22 of the housing sections 12*a* and 12*b* functioning as the handle portion of the housing 12 by means of which the fastener driving tool may be manipulated and controlled, as will be described in more detail hereinafter. The housing sections 12*a* and 12*b* are held together by a plurality of screws (not shown) which extend through openings 21 in the housing sections 12*a* and 12*b*, the housing section 12*a* having exterior hexagonal recesses 23 surrounding the openings 21 to receive nuts positioned on the end of these screws.

A flexible drive belt 24 which interconnects a pulley 26 secured to the flywheel shaft 28 and a pulley 30 mounted on the end of the rotor shaft 32 of the electric motor 18, is provided to drive the flywheel 14 from the electric motor 18. The drive belt 24 and pulleys 26, 30 are totally enclosed by providing a removable panel 34 which cooperates with an outwardly extending flange portion 36 of the housing section 12*a* to enclose these components. The fastener driving tool 10 also includes a fastener driving member or ram 40 which extends downwardly from a removable cartridge indicated generally at 42 and is positioned between the periphery of the flywheel 14 and an idler wheel 44.

Figures 4, 5, 10:
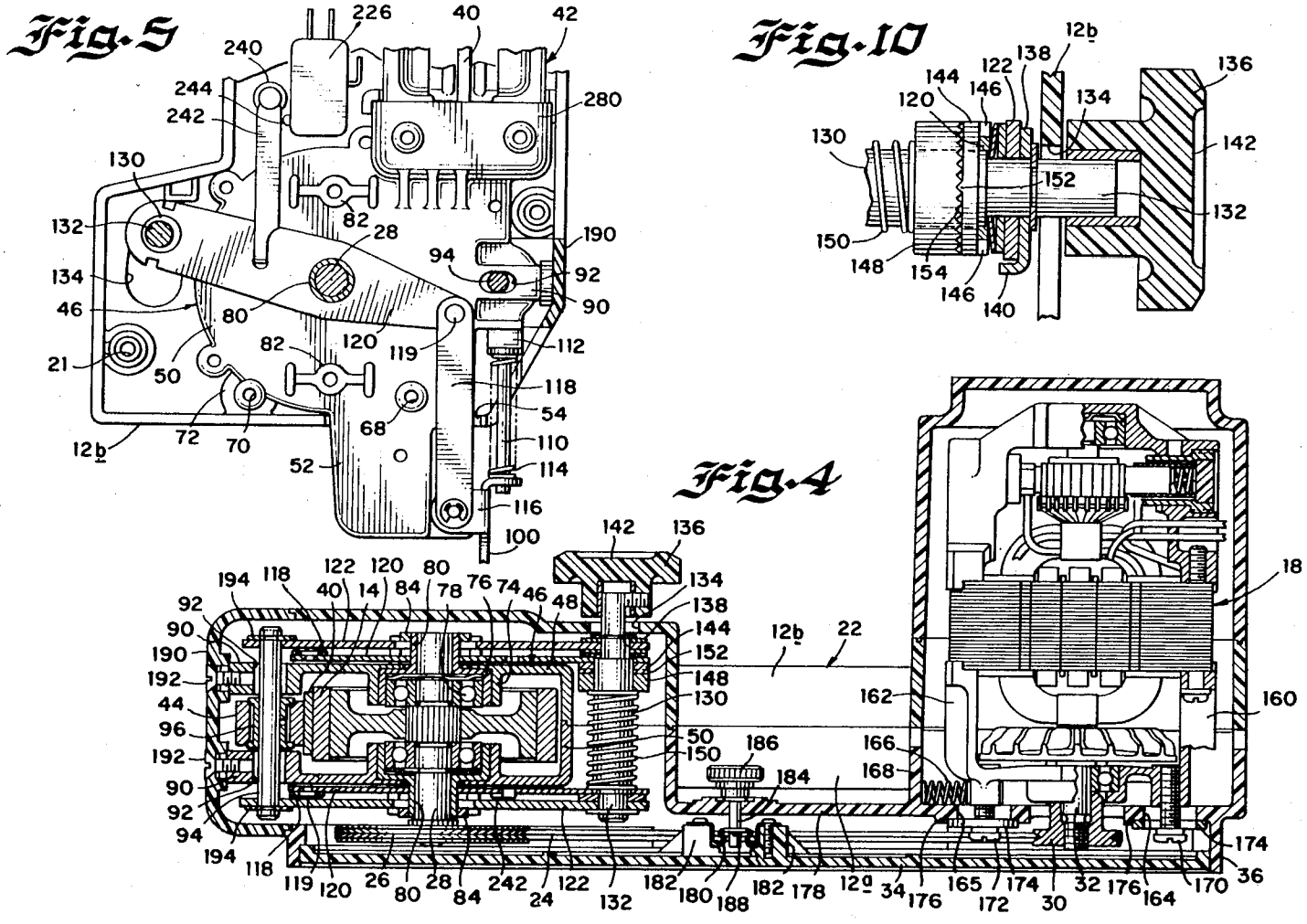
FIG. 4 is a sectional view taken along the line 4—4 of FIG. 1 but with both sections of the plastic housing in place.
FIG. 5 is a fragmentary left side elevation of the tool of FIG. 1 showing the drive housing subassembly from the opposite side as FIG. 3.
FIG. 10 is a sectional view, taken along the line 10—10 of FIG. 3, somewhat enlarged.
Figure 5:
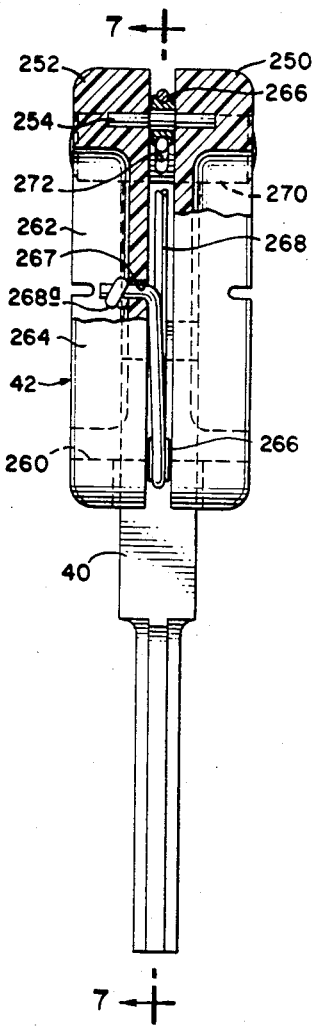

In accordance with an important aspect of the present invention, the flywheel 14, idler wheel 44 and cartridge 42 including the ram 40, are mounted in a drive housing subassembly indicated generally at 46 which comprises the opposed cast metal housing sections 48 and 50 (FIG. 4). The subassembly 46 is provided with a downwardly extending portion 52 which extends through a clearance opening 54 in the housing section 12*a*, and a corresponding opening in the housing section 12*b*, and a nosepiece 56 is rigidly secured to the subassembly portion 52 by means of the screws 58 (FIG. 3) which extend through depending lobe portions 60 on the housing sections 48, 50 and are secured by the nuts 62. The screws 58 also support the forward end of a magazine 64 which contains the fasteners to be driven, the rear end of the magazine 64 being secured to a depending flange portion 66 (FIG. 1) of the housing section 12*a*. In the illustrated embodiment, the magazine 64 is designed to hold U-shaped staples, but other suitable magazines, such as those designed to hold nails or other fasteners, may be used with appropriate modifications to the fastener driving tool 10.

Figure 2:
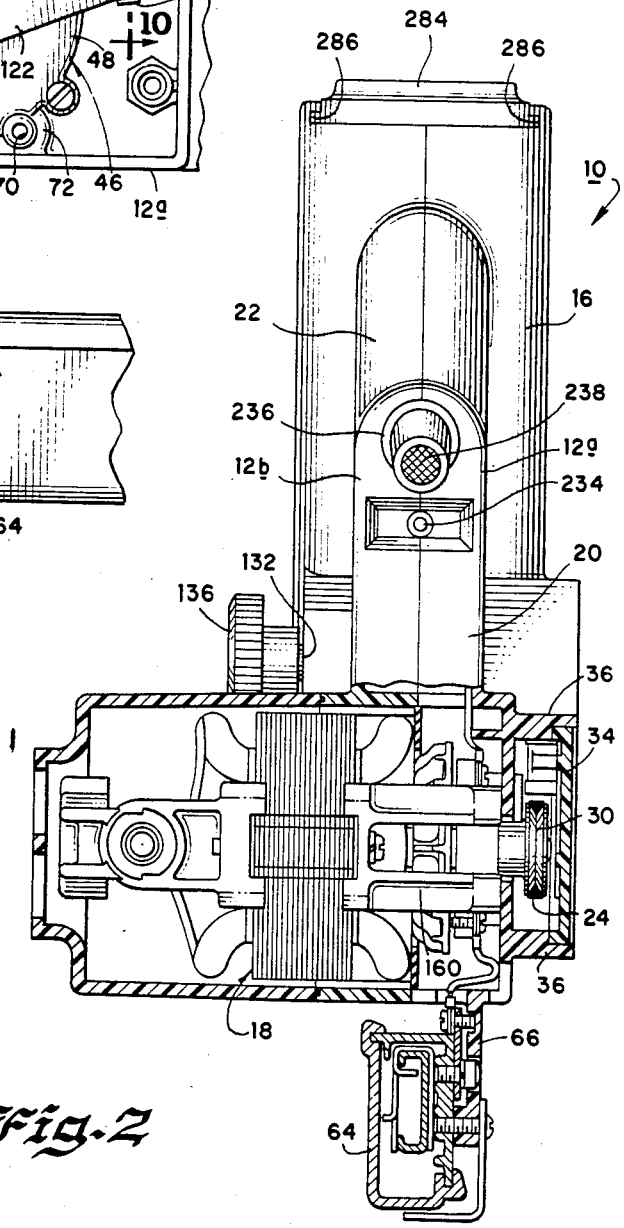
FIG. 2 is a rear view of the fastener driving tool of the present invention shown with both halves of the plastic housing in place.

The subassembly 46 and nosepiece 56 form a self-contained unit which is independent of the housing sections 12*a*, 12*b* and may be operated to drive a fastener from the magazine 64 into the workpiece by engaging the flywheel 14 with the ram 40, as described in more detail hereinafter. Furthermore, the subassembly 46 is connected to the housing sections 12*a*, 12*b* at only two spaced points so that the impact forces which are developed when the flywheel 14 engages the ram 40 are absorbed primarily by the rugged casting sections 48, 50 of the subassembly 46 and are not transmitted through the plastic housing 12 to the control components of the fastener driving tool 10. More particularly, the housing sections 12*a*, 12*b* are connected to the subassembly 46 by means of screws (not shown) which extend through the spaced openings 68, 70 provided in the housing sections 48, 50, the housing section 12*a* being provided with a pair of tab portions 72 (one of which is shown in FIGS. 1, 2 and 5) for receiving the screws which are mounted in the holes 68, 70. It will be noted that these screws are located near the bottom of the subassembly 46 and well below the handle portion 22 of the housing 12 so that the reaction forces developed when a ram 40 drives a fastener into the workpiece are absorbed in the subassembly 46 and the cartridge 42 without being transmitted to the housing 12. It will also be noted that the subassembly 46 is connected to the housing 12 at the points (68, 70) which are positioned on either side of the flywheel shaft 28 to provide a balanced arrangement with respect to the reaction forces produced by engagement of the flywheel 14 with the ram 40.

Figure 3:
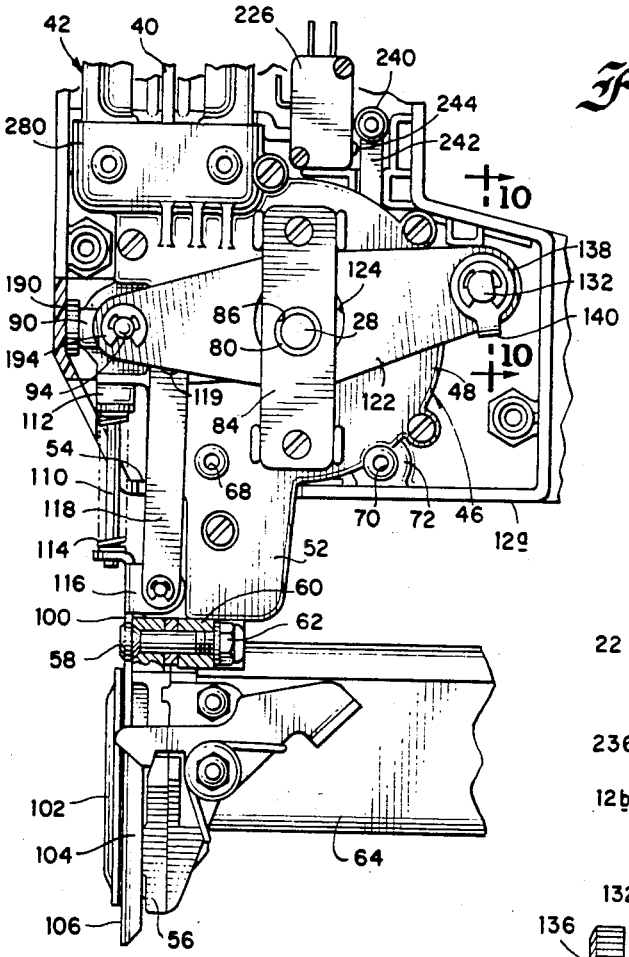
FIG. 3 is a fragmentary view similar to FIG. 1 but showing the complete drive housing subassembly positioned within the right hand plastic housing section.

Considering now in more detail the manner in which the flywheel 14 and idler wheel 44 are mounted within the subassembly 46, each of the cast housing sections 48, 50 is provided with an inwardly directed annular flange portion 74 (FIG. 4) which is adapted to receive the inwardly directed cup-shaped bearing supports 76 within which the ball bearing assemblies 78 are positioned. Each of the bearing supports 76 is also provided with an outwardly extending bearing sleeve portion 80. The flywheel 14 is press fitted on the shaft 28, this shaft being rotatably mounted in the bearing assemblies 78 and extending outwardly through the bearing sleeve portion 80 of the housing section 50, as best illustrated in FIG. 4. In order to provide a rigid support for the outer ends of the bearing sleeves 80, each of the housing sections 48, 50 is provided with a pair of raised boss portions 82 (FIG. 5) which are spaced from the bearing sleeves 80 and provide support for a pair of retainer plates 84 (FIGS. 3 and 4). The retainer plates 84 are provided with openings 86 (FIG. 3) which are adapted to receive the outer ends of the bearing sleeves 80 and provide support therefor. Also, the plates 84 act to retain the toggle mechanism which is mounted on the subassembly 46 in place, as will be described in more detail hereinafter.

In order to mount the idler wheel 44 on the subassembly 46, each of the housing sections 48, 50 is provided with a forwardly projecting portion 90, each of these portions having a slot 92 (FIG. 5) therein which is adapted to receive a transversely extending idler shaft 94. The idler 44 and associated bearing portion 96 is mounted on the shaft 94 and is positioned between the forwardly projecting portions 90 on the housing sections 48, 50.

In accordance with a further important aspect of the present invention, the subassembly 46 is also employed to mount the component levers of a toggle mechanism which is employed to position the shaft 94 within the slots 92 and hence position the idler wheel 44 relative to the ram 20. More particularly, a vertically extending safety yoke 100 is slidably mounted between the nosepiece 56 and a guard 102 which is mounted on the nosepiece 56, the bottom portion of the safety yoke 100 being provided with rearwardly extending flange portions 104 to provide an end section 106 of U-shaped cross section of substantial strength. The upper end of the safety yoke 100 is provided with a right angle end portion 108 which is adapted to receive a pin 110 which extends between downwardly extending boss portions 112 on the housing sections 48, 50 and the right angle end portion 108, the pin 110 serving to guide the upper end of the safety yoke 100 during vertical movement thereof and also retains a coil spring 114 which normally biases the safety yoke 100 downwardly so that the end portion 106 thereof projects below the nosepiece 56. The safety yoke 100 is provided with offset rearwardly extending ear portions 116 to each of which the bottom end of a vertically extending link member 118 (FIG. 3) is pivotally connected, it being understood that the link members 118 extend upwardly on either side of the drive housing subassembly 46, as best illustrated in FIGS. 3 and 5. Each of the links 118 is connected at its upper end to one of a toggle lever 120 by means of the pin 119, the lever 120 being rotatably mounted on the bearing sleeve 80. The other ends of the levers 120 are pivotally interconnected with one end of a pair of second toggle levers 122 which are positioned outside of the levers 120 and have clearance openings 124 for the bearing sleeves 80.

When the fastener driving tool 10 is not in engagement with the work, the safety yoke 100 is biased to its lowermost position by the coil spring 114 and the toggle levers 120 and 122 are in such position that the idler wheel 44 on the shaft 94 is positioned well away from the ram 40 so as to prevent inadvertent engagement of the ram 40 by the flywheel 14. However, when the tool 10 is moved into engagement with the work the end portion 106 of the safety yoke 100 is moved upwardly so that the toggle levers 120 are rotated about the bearing sleeves 80 in a counterclockwise direction as viewed in FIG. 5 and the outer ends of the levers 120 are moved downwardly so that the control levers 122 connected thereto are moved to a closed toggle position in which the idler wheel 44 moves inwardly toward the ram 40 to a position at which the idler wheel 40 is closely adjacent the ram. In this position the ram 40 is arranged to be selectively engaged by the flywheel 14 and driven downwardly to drive a fastener into the workpiece, as will be described in more detail hereinafter.

As discussed generally heretofore, it is important to be able to adjust the spacing between the idler wheel 44 and the ram 40 in order to achieve optimum driving conditions for engagement of the flywheel 14 with the ram 40. Furthermore, such adjusting means should be readily accessible and adjustable by the user. In accordance with an important aspect of the present invention, these advantages are achieved by providing a control shaft 130 (FIG. 4) which is rotatably mounted in the inner toggle control levers 120. The control shaft 130 extends outwardly through the outer control levers 122 and is interconnected therewith by means of the eccentric shoulders 132 (FIG. 5) on the shaft 130. One end of the control shaft 130 extends outwardly through an opening 134 in the right hand housing section **12*b* and a control knob 136 is secured to this projecting outer end of the control shaft 130. Accordingly, when the control knob 136 is rotated, the eccentric shoulders 132 function to move the control levers 122 relative to the control levers 120 and thus adjusts the position of the idler wheel 44 relative to the ram 40. With this arrangement, the user can achieve optimum driving conditions for the flywheel 14 by driving a fastener into a test block and rotating the control knob until the idler wheel 44 is adjusted for optimum driving conditions in which the fastener is driven completely into the workpiece but is not driven too far into the surface thereof. Preferably, the range of rotation of the control knob is limited by a washer 138 which is positioned on the control shaft 130 and is keyed thereto, the washer 138 having a downturned lug 140 (FIG. 3) which is adapted to engage the edges of one of the control levers 122 to limit rotation of the knob 136 to approximately 180°. With such an arrangement rotation of the knob 136 in a particular direction always functions to move the idler 44 closer to the ram 40 and hence increase the force with which the flywheel 14 drives the ram 40 downwardly. The upper surface 142 of the control knob 136 may have a suitable indicia mounted therein so that the user is informed which direction the knob 136 should be rotated to gradually increase the force exerted on the ram 40** so that the optimum driving conditions can be achieved.

In order to maintain the control shaft 130 in its optimally adjusted position, a pawl and ratchet type of detent mechanism is provided. More particularly, a detent pawl disc 144 (FIG. 10) is mounted on the control shaft 30 and is provided with ear portions 146 which engage in corresponding notches in the edge of the inner control lever 120 which is mounted on the housing section 48 to prevent the pawl disc 144 from rotating. A pawl disc 148 is also mounted on a shoulder (not shown) on the control shaft 130 and is keyed thereto for rotation therewith and sliding movement away from said shoulder. The opposing faces of the discs 144 and 148 are provided with cooperating detent means, these opposing faces being held in engagement by means of a coil spring 150 which is mounted on the control shaft 130 between the disc 148 and the lever 120 associated with the housing section 50. This detent means comprises a pair of opposed radially extending ridges 152 on the disc 144 which are urged into engagement with opposing ones of an annular series of radially extending grooves 154 provided in the opposing face of the disc 148. Accordingly, the control knob 136 cannot be rotated unless sufficient torque is exerted on this knob to overcome the detent action of the above-described detent means. The annular series of radially extending grooves 154 are preferably sufficiently fine to provide an accurate adjustment of the position of the knob 136 when the control shaft 130 is rotated to achieve optimum driving conditions as described heretofore. A bowed washer 151 is also provided on the shaft 130 between the levers 120 and 122 which functions to hold the opposing faces of the discs 144 and 148 together. If desired, the disc 148 may be made integral with the control shaft 130 and the coil spring 150 eliminated. The bowed washer 151 will then function to hold the opposing faces of the discs 144 and 148 together while permitting these faces to slip relative to one another when sufficient torque is exerted on the control knob 136.

As described generally heretofore, it has been found that the tension in the drive belt 24 should preferably have an optimum value in order to drive the flywheel 14 at high speed and yet provide for long life of the drive belt 24. If the tension in the belt 24 is initially made too great, or if the belt is replaced and too great a tension is established in it, the belt may wear out quite quickly. On the other hand, if the belt is too loose it cannot bring the flywheel 14 up to the desired high speed as quickly as desired, or it may slip so much that the flywheel 14 cannot be driven at the required high speed.

In accordance with an important aspect of the present invention, an automatic belt tensioning arrangement is provided whereby the optimum value of tension in the belt 24 can be established. More particularly, the base of the electric motor 18 includes first and second pairs of depending foot portions 160 and 162 (FIG. 4) which are positioned in corresponding slots 164 and 165 in the housing section 12*a* so that the electric motor 18 is slidably mounted on the housing section 12*a*. A pair of coil springs 166 (FIG. 4) are positioned between an upstanding flange portion 168 of the housing section 12*a* and the depending feet 162 of the electric motor 18 so that the motor 18 is urged in the direction to increase the tension in the drive belt 24. Preferably, the coil springs 166 are arranged to provide a tension of seven pounds in the drive belt 24. In order to lock the movable base of the motor 18 in the correct position at which such optimal tension is established, the screws 170 extend through the slots 164 and into the feet 160 and the screw 172 extends through one of the slots 165 and into one of the feet 162. In order that the screws 170, 172 may securely clamp the motor 18 to the housing section 12*a*, these screws are preferably positioned within elongated metal washers 174 which are seated in elongated boss portions 176 formed in the wall 178 of the housing section 12*a* and onto which the head portions of the screws 170, 172 are tightened.

As is described generally heretofore, the drive belt 24 and pulleys 26, 30 are enclosed within the housing section 12*a* by means of the removable panel 34. The panel 34 is preferably held in the position shown in FIG. 4 by means of a quick release mechanism whereby the panel 34 may be readily removed to permit replacement of the belt 24 or adjustment of the tension in this belt by loosening the screws 170, 172 so as to permit the coil spring 166 to establish the optimum value of tension in the belt and then retightening these screws. More particularly, this quick release mechanism includes a bayonet type latch or socket 180 which is mounted on the post portions 182 on the inside of the panel 34 and cooperates with a locking pin 184 which is loosely mounted in the wall 178 of the housing section 12*a* and has an externally accessible knob 186 secured thereto. With this arrangement the panel 34 is securely held in place when the transverse latch pin 188 on the end of the pin 184 is in mesh with the bayonet socket 180 and yet the panel may be quickly released by rotating the knob 185 a quarter of a turn which permits removal of the pin 184 from the socket 180.

In order to provide access to the idler wheel shaft 94, so that the idler wheel 44 may be removed and replaced without separating the two housing sections 12*a* and 12*b*, a separate, removable U-shaped panel 190 (FIG. 4) is mounted on the projecting portions 90 of the drive housing subassembly 46 by means of the screws 192. Removal of the panel 190 provides access to the C washers 194 on the ends of the idler wheel shaft 94 which may then be removed and the shaft slid sideways to remove the idler wheel 44 from the subassembly 46.

Figure 7:
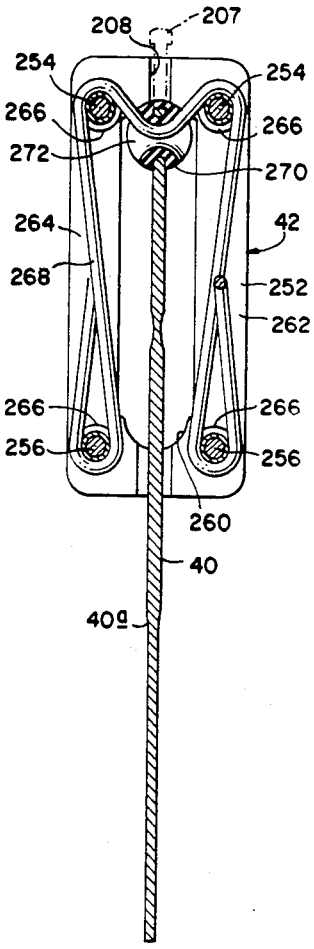
FIG. 7 is a sectional view taken along the line 7—7 of FIG. 6.

Considering now the manner in which the flywheel 14 is selectively engaged with the ram 40 after the tool has been moved into engagement with the work and the idler wheel 44 positioned relatively close to the ram 40, a solenoid 200 is mounted in the housing section 12*a* and the upper end of the armature shaft 202 of the solenoid 200 is interconnected with a lever 204 the other end of which extends through a slot in a bracket 206 mounted in the housing section 12*a* to provide a pivotal support for said other end of the lever 204. When the solenoid 200 is energized the armature 202 thereof moves downwardly which causes a follower member 207, which is positioned beneath the lever 204 and is loosely mounted in a slot 208 in the cartridge 42, to also move downwardly and move the ram 40 downwardly by an amount such that a wider portion of the ram 40*a* (FIG. 7) is moved between the flywheel 14 and the idler wheel 44 so that the flywheel 14 engages the ram and moves it rapidly downwardly to drive a fastener in the magazine 64 into the workpiece.

Figure 9:
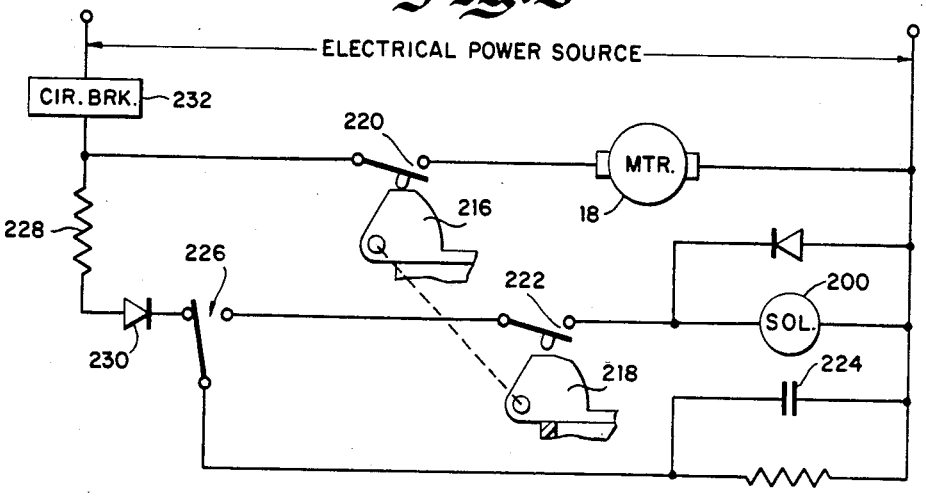
FIG. 9 is a schematic diagram illustrating the operation of the two position trigger arrangement of the present invention.

The manner in which the solenoid 200 is energized is generally similar to the arrangement described in detail in said copending Kerrigan application and reference may be had to said copending application for a detailed description thereof. However, in accordance with the present invention, a two position trigger arrangement is provided for sequentially energizing first the electric motor 18 and then the solenoid 200. More particularly, a trigger element 210 is pivotally mounted on a locating pin 212 provided in the housing section 12*a* and is biased to the inoperative position shown in FIG. 1 by means of the torsion spring 214 which is positioned on the pin 212. The trigger element 210 is provided with a pair of lobe portions 216 and 218 which are arranged to sequentially actuate a pair of switches 220 and 222 which are mounted one on top of the other on the housing section 12*a*. The manner in which the lobe sections 216 and 218 function to sequentially actuate the switches 220 and 222 is shown diagrammatically in FIG. 9. Referring to this figure, when the handle portion 22 is grasped by the user and the trigger element 210 is rotated about the pin 212 a small amount, the lobe 216 closes the switch 220 so that the motor 18 is energized and brings the flywheel 14 up to speed. When the trigger element 210 is rotated an additional amount about the pin 212 the lobe 218 then closes the switch 222 which conditions the solenoid 200 to be energized. As described in said copending Kerrigan application, the solenoid 200 is preferably energized from a capacitor 224 which is initially charged through a safety or arming switch 226 (mounted on the housing section 12*a*) when the tool 10 is out of engagement with the workpiece and the safety yoke 100 is in the down position shown in FIG. 1. More particularly, when the switch 226 is in the position shown in FIG. 9 the capacitor 224 is charged from the power line through a resistor 228 and rectifier 230. When the tool 10 is moved into engagement with a workpiece and the safety yoke 100 moves upwardly, the switch 226 is actuated to the opposite position from that shown in FIG. 9. The switch 226 is now connected in series with the switch 222 and the charged capacitor 224 is connected to the solenoid 200 to energize the same when the trigger element 210 is depressed the full amount so that the lobe portion 218 thereof closes the switch 222.

In accordance with a further aspect of the present invention the motor 18 and solenoid 200 are connected to the power line through a circuit breaker 232 which is mounted in the rear sections 20 of the housing sections 12*a* and 12*b*, the reset pin 234 of the circuit breaker 232 extending outwardly through an opening in the housing sections 12*a*, 12*b* immediately beneath the sleeve portion 236 of the power cord 238. With such an arrangement the circuit breaker reset button 234 is protected by the sleeve 236 and yet is readily accessible in the event the motor 18 is overloaded and opens the circuit breaker 232.

In accordance with a further aspect of the invention the safety switch 226 is actuated by a roller 240 which is positioned on the upper end of a control arm 242 the lower end of which is interconnected with one of the toggle control levers 120, as best illustrated in FIG. 5. When the safety yoke 100 is in the down position shown in FIGS. 1 and 5, the roller 240 is out of engagement with the actuating lobe 244 of the safety switch 226 so that the switch occupies the position shown in FIG. 9 and permits the capacitor 224 to charge. When the tool 10 is moved into engagement with a workpiece the control arm 242 moves downwardly so that the roller 240 engages the lobe 244 of the switch 226 and actuates it to the opposite position so that the switch 226 is connected in series with the switch 222. It will be noted that this actuation of the switch 226 occurs as soon as the safety yoke 100 is moved upwardly and without any actuation of the trigger element 210. Accordingly, when the trigger element 210 is squeezed, the switch 220 is first closed so as to energize the motor 18 and bring the flywheel 14 up to speed, and then when the trigger element 210 is further rotated the switch 222 is closed so that the solenoid 200 is energized from the charged capacitor 220. The solenoid 200 cannot be again energized to drive another fastener until the tool 10 is removed from the workpiece and the safety yoke 100 moves downwardly so that the switch 226 is moved to the position shown in FIG. 9 to permit the capacitor 224 to again be charged. In the alternative, the trigger element 210 may first be fully squeezed so that both of the switches 220 and 222 are closed. When this occurs the motor 18 is brought up to speed but the solenoid 200 is not energized because the switch 226 is still in the safety or arming position. However, with the trigger 210 fully squeezed, the safety yoke 106 may now be moved into engagement with the workpiece and as soon as the yoke 100 moves upwardly and the roller moves off of the lobe 244, the switch 226 is actuated to its other position and a fastener is driven into the workpiece. It will be noted that the control arm 242 and roller 240 provide an arrangement which insures positive actuation of the switch 226 in coordination with movement of the safety yoke 100. Furthermore, the roller 240 moves along a shoulder 241 formed in the housing section 12*a* so that positive actuation of the switch 226 in response to vertical movement of the control arm 242 is insured.

Figure 8:
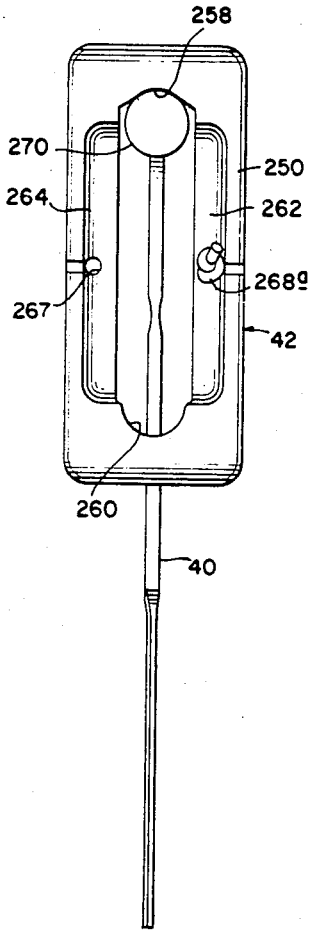
FIG. 8 is a right side elevation of the cartridge of FIG. 6.

In accordance with a further aspect of the present invention, a simplified and low cost cartridge 42 is provided which supports the ram 40 in its uppermost position and returns the ram to this position after it has been moved downwardly by engagement with the flywheel 14. The cartridge 42 is generally similar to the corresponding arrangement described in detail in said copending Kerrigan application and reference may be had to said application for a detailed description thereof. However, the cartridge 42 of the present invention is of simplified construction and is of sufficiently low cost that the cartridges 42 may be simply replaced rather than attempting to remove a worn ram from the cartridge and place a new one in the old cartridge. More particularly, a pair of molded plastic housing sections or support members 250 and 252 are positioned in opposed relation by means of a first pair of pins 254 which are positioned in the upper end of the supports 250, 252 and a second pair of pins 256 which are positioned at the bottom end of the supports 250, 252. Each of the supports 250 and 252 has an upper bumper surface 258 and a lower bumper surface 260, the bumper portions 258, 260 being integrally formed with a pair of side walls 262 and 264 so that each support is of molded one piece construction. Preferably, the support sections 250 and 252 are identical so that they can be manufactured at low cost. A pulley 266 is positioned on each of the pins 254 and 256 and an elastic cord 268 is interconnected with the ram 40 and the pulleys 266 so as to return the ram to its uppermost position after it has been moved downwardly by the flywheel 14 and has driven a fastener into a workpiece. More particularly, the ram 40 is provided with a transverse cylindrically shaped head portion 270 which is molded onto the upper end of the ram 40, the head portion being provided with an opening 272 through which the mid portion of the cord 268 extends. The cord 268 extends over the pulleys mounted on the upper pins 254 and then downwardly and around the pulleys mounted on the lower pins 256, the ends of the cord 268 being secured in openings 267 in the integral side walls 262 and 264 of the supports 250, 252 by tying a knot 268*a* in the manner shown in FIG. 8.

In accordance with a further aspect of the present invention, the drive housing subassembly 46 is provided with a rectangular upper wall portion 280 (FIG. 3) within which the bottom end of the cartridge 42 may be positioned so as to accurately locate and position the ram 40 relative to the flywheel 14 and idler 44. Also, the housing sections 48, 50 are shaped to define a drive slot 282 which guides the end of the ram 40 as the cartridge 42 is inserted into the top opening recess defined by the walls 280. With such an arrangement the cartridge 42 is solidly mounted on the subassembly 46 which, as described in detail heretofore is effectively isolated from the plastic housing 12 and the components carried thereby.

In accordance with a further aspect of the present invention a cover plate 284 is slidably mounted in grooves 286 formed in the housing sections 12*a* and 12*b*. The cover plate 284 may be moved to the right, as viewed in FIG. 1 by an amount sufficient to expose the cartridge 42 so that this cartridge may be removed and replaced. However, the cover 284 is prevented from being removed completely from the housing 12 by providing depending stop flanges 288 on the cover 284 which engage shoulders 290 on the housing sections 12*a* and 12*b* and prevent the cover from being completely removed and lost. In order to remove the cartridge 42 it is first necessary to disconnect the lever 204 from the bracket 206 after which it may be lifted away from the armature shaft 202 of the solenoid 200 whereupon the cartridge 42 can be removed out of the top of the housing 12.

While there has been described what is at present considered to be the preferred embodiment of the invention, it will be understood that various modifications may be made therein which are within the true spirit and scope of the invention.

What is claimed as new and desired to be secured by Letters Patent of the United States is:

1. A tool for driving fasteners comprising:

a support structure;

impact means including flywheel means mounted on said support structure and fastener driving means driven by said flywheel means;

an electric motor having a base movably mounted on said support structure and spaced from said flywheel means;

a flexible element interconnecting said flywheel means in the rotor of said electric motor;

means for urging the base of said electric motor in the direction to increase the tension in said flexible element to a predetermined value; and means for releasably securing the base of said electric motor to said support structure, whereby the tension in said flexible element may be adjusted to said predetermined value by releasing said securing means to permit said urging means to increase the tension in said flexible element to said predetermined value.

2. A tool as set forth in claim 1, wherein said tensioning means comprises spring means connected to the base of said electric motor for urging the same in said direction.

3. A tool as set forth in claim 2, wherein said spring means comprises compression spring means positioned between said support structure and the movable base of said electric motor and urging said base in said direction.

4. A tool as set forth in claim 1, which includes means for preventing the base of said electric motor from moving relative to said support structure when the tension in said flexible element has said predetermined value.

5. A tool for driving fasteners comprising:

a support structure;

impact means including flywheel means mounted on said support structure and fastener driving means driven by said flywheel means;

an electric motor having a base movably mounted on said support structure and spaced from said flywheel means;

a flexible element interconnecting said flywheel means and the rotor of said electric motor;

means for urging the base of said electric motor in the direction to increase the tension in said flexible element to a predetermined value;

wherein said tensioning means comprises spring means connected to the base of said electric motor for urging the same in said direction;

wherein said spring means comprises compression spring means positioned between said support structure and the movable base of the electric motor and urging said base in said direction; and wherein said movable base includes a pair of leg portions extending parallel to the rotor axis of said electric motor, and said compression spring means comprises a pair of compression coil springs in individual engagement with said pair of leg portions.

6. A tool as set forth in claim 5, wherein said support structure includes grooves adapted to received said pair of leg portions for guiding the same during movement of said electric motor in said direction.

7. A tool as set forth in claim 6, wherein said base includes a second pair of leg portions spaced from said first named pair of leg portions and positioned in grooves in said support structure for guiding said base during movement of said motor in said direction.

8. A tool for driving fasteners comprising:

a support structure;

impact means including flywheel means mounted on said support structure and fastener driving means driven by said flywheel means;

an electric motor having a base movably mounted on said support structure and spaced from said flywheel means;

a flexible element interconnecting said flywheel means and the rotor of said electric motor;

means for urging the base of said electric motor in the direction to increase the tension in said flexible element to a predetermined value;

wherein said tensioning means comprises spring means connected to the base of said electric motor for urging the same in said direction;

wherein said spring means comprises compression spring means positioned between said support structure and the movable base of the electric motor and urging said base in said direction; and wherein said compression means comprises a pair of coil springs which engage said movable base on opposite sides of the rotor axis of said electric motor.

9. A tool for driving fasteners comprising:

a support structure;

impact means including flywheel means mounted on said support structure and fastener driving means driven by said flywheel means;

an electric motor having a base movably mounted on said support structure and spaced from said flywheel means;

a flexible element interconnecting said flywheel means and the rotor of said electric motor;

means for urging the base of said electric motor in the direction to increase the tension in said flexible element to a predetermined value;

wherein said tensioning means comprises spring means connected to the base of said electric motor for urging the same in said direction;

wherein said spring means comprises compression spring means positioned between said support structure and the movable base of the electric motor and urging said base in said direction; and means for releasably securing the base of said electric motor to said support structure, whereby the tension in said flexible element may be adjusted to said predetermined value by releasing said securing means to permit said compression spring means to increase the tension in said flexible element to said predetermined value.

10. A tool as set forth in claim 9, wherein said movable base includes at least one leg portion extending parallel to the rotor axis of said electric motor and said releasable securing means comprises a screw extending into said one leg portion.

11. A tool as set forth in claim 9, wherein said movable base includes a plurality of leg portions extending parallel to the rotor axis of said electric motor and positioned on opposite sides thereof, and said releasable securing means comprises a plurality of screws extending through slots in said support structure and into said plurality of leg portions.

12. A tool as set forth in claim 9, wherein said support structure includes a housing enclosing said flexible element and said releasable securing means, said housing having a removable portion to permit access to said releasable securing means.

13. A tool for driving fasteners comprising:

a housing;

impact means including flywheel means positioned within said housing and fastener driving means driven by said flywheel means;

an electric motor movably mounted within said housing and spaced from said flywheel means;

means positioned within said housing including a flexible belt for coupling said flywheel means and the rotor of said electric motor;

means positioned within said housing for urging the movable base of said electric motor in the direction to increase the tension in said flexible belt to a predetermined value; and means positioned within said housing for releasably securing the base of said electric motor to said housing, whereby the tension in said flexible belt may be adjusted to said predetermined value by releasing said securing means, thereby to permit said urging means to increase the tension in said flexible belt to said predetermined value.

14. A tool as set forth in claim 13, wherein said housing includes a removable panel to provide access to said releasable securing means.

15. In a tool for driving fasteners of the type having a ram mounted for reciprocation between an upper and lower position, a flywheel selectively engaging said ram to drive said ram from said upper position to said lower position and an electric motor for rotating said flywheel at high speed, the improvement comprising:

a cast drive housing subassembly having opposed housing sections which support and enclose said flywheel;

bearing means for said flywheel mounted in said opposed housing sections;

means on said opposed housing sections defining a slot within which said ram may move between said upper and lower positions; and a plastic housing enclosing said ram and at least a portion of said drive housing subassembly and means for connecting said drive housing subassembly to said plastic housing for reducing impact forces resulting from engagement of said flywheel with said ram so that the impact forces are absorbed primarily by said drive housing subassembly.

16. The tool as set forth in claim 15, wherein said drive housing subassembly is secured to said plastic housing sections at points spaced on either side of the axis of rotation of said flywheel.

17. The tool set forth in claim 15, which includes an idler wheel rotatably mounted on said drive housing subassembly and disposed adjacent said ram on the side thereof opposite said flywheel.

18. The tool set forth in claim 17, which includes means carried by said drive housing subassembly for affecting movement of one of said flywheel and said idler wheel between a released position wherein the ram is maintained in a spaced relationship with the periphery of the flywheel and an engaged position wherein the ram is brought closer to the periphery of the flywheel.

19. The tool set forth in claim 18, wherein said relative movement operating means includes a toggle mechanism mounted on said drive housing subassembly and connected to one of said flywheel and said idler wheel, said toggle mechanism being movable between an open and a closed position and serving to move the idler wheel and the flywheel closer together when moved from said open position to said closed position.

20. The tool set forth in claim 17, wherein said idler wheel is enclosed within said plastic housing, said plastic housing having a removable panel in the vicinity of said idler wheel to permit service thereon or replacement thereof.

21. The tool set forth in claim 17, wherein said drive housing subassembly includes a pair of projecting portions, said idler wheel being rotatably mounted on an axle journalled in said projecting portions, said removable panel providing access to said axle so that said axle can be removed from said projecting portions to permit removal of said idler wheel.

22. The tool set forth in claim 21, wherein said removable panel is mounted on said projecting portions of said drive housing subassembly.

23. In the tool for driving fasteners of the type having a ram mounted for reciprocation between an upper and lower position, a flywheel selectively engaging said ram to drive said ram from said upper position to said lower position and an electric motor for rotating said flywheel at high speed, the improvement comprising:

a cast drive housing subassembly having opposed housing sections which support and enclose said flywheel;

bearing means for said flywheel mounted in said opposed housing section;

means on said opposed housing sections defining a slot within which said ram may move between said upper and lower positions;

a plastic housing enclosing said ram and at least a portion of said drive housing subassembly and connected to said drive housing subassembly in such a manner that impact forces resulting from engagement of said flywheel with said ram are observed primarily by said drive housing subassembly;

an idler wheel rotatably mounted on said drive housing subassembly and disposed adjacent said ram on the side thereof opposite said flywheel;

means carried by said drive housing subassembly for affecting relative movement between said flywheel and said idler wheel between a release position wherein the ram is maintained in a spaced relationship with the periphery of the flywheel and engaged position wherein the ram is brought closer to the periphery of the flywheel;

wherein said relative movement operating means includes a toggle mechanism mounted on said drive housing subassembly and connected to one of said flywheel and said idler wheel, said toggle mechanism being movable between an open and a closed position and serving to move the idler wheel and the flywheel closer together when moved from said open position to said closed position; and wherein said toggle mechanism includes a first member pivotally mounted on said drive housing subassembly, and a second member connected to one end of said first member and connected at the other end to said idler wheel, and means connected to the other end of said first member for rotating said first member in response to engagement of the tool with the workpiece, thereby to move said toggle mechanism from said open position to said closed position.

24. The tool set forth in claim 23, wherein said rotating means comprises a linkage extending downwardly from said other end of said first member, and means including a coil spring positioned between said drive housing subassembly and said linkage for biasing said linkage to a lower position when the tool is not in engagement with a workpiece.

25. The tool set forth in claim 23, wherein said idler wheel is mounted on an axle which extends outwardly through said drive housing subassembly and said other end of said second member is connected to said axle.

26. In a tool for driving fasteners of the type having a ram mounted for reciprocation between an upper and a lower position, a flywheel selectively engaging said ram to drive said ram from said upper position to said lower position and an electric motor for rotating said flywheel at high speed, the improvement comprising:

a cast drive housing subassembly having opposed housing sections which support and enclose said flywheel;

bearing means for said flywheel mounted in said opposed housing sections;

means on said opposing housing sections defining a slot within which said ram may move between said upper and lower positions;

a plastic housing enclosing said ram and at least a portion of said drive housing subassembly and connected to said drive housing subassembly in such a manner that impact forces resulting from engagement of said flywheel with said ram are absorbed primarily by said drive housing subassembly;

an idler wheel rotatably mounted on said drive housing subassembly and disposed adjacent said ram on the side thereof opposite said flywheel;

wherein said drive housing subassembly includes a bearing sleeve coaxial with said flywheel and extending outwardly from the side thereof, a first member pivotally mounted on said bearing sleeve, a second member positioned outside said first member and having a clearance opening through which said bearing sleeve extends, means pivotally connecting one end of said first member to one end of said second member, means pivotally connecting the other end of said second member to said idler wheel, said first and second members forming a toggle mechanism in which rotation of said first member about said bearing sleeve is effective to move said idler wheel closer to said flywheel.

27. The tool set forth in claim 26, which includes means connected to said first member at a point on the other side of said bearing sleeve from said one end thereof for rotating said first member in response to engagement of the tool with a workpiece.

28. The tool set forth in claim 27, wherein said point on said first member is directly above the point of engagement of the tool with a workpiece.

29. The tool set forth in claim 27, which includes a nosepiece secured to said drive housing subassembly and extending downwardly therefrom through which a fastener is driven into the workpiece by said ram, said point on said first member being directly above said nosepiece.

30. The tool set forth in claim 29, wherein said rotating means comprises a vertically extending member positioned adjacent said nosepiece and extending therebelow and a link pivotally interconnecting the upper end of said vertically extending member and said point on said first member, said vertically extending member being moved upwardly by engagement with a workpiece to rotate said first member about said bearing sleeve.

31. The tool set forth in claim 30, which includes a coil spring positioned between said drive housing subassembly and the upper end of said vertically extending member for biasing said vertically extending member downwardly when the tool is not in engagement with a workpiece.

32. The tool set forth in claim 30, which includes a guard member connected to said nosepiece and cooperating therewith to guide said vertically extending member during vertical movement thereof.

33. The tool set forth in claim 27, which includes a safety switch for controlling the selective engagement of said flywheel with said ram, said safety switch being mounted in said plastic housing, above said drive housing subassembly, and a switch activating arm pivotally connected to said first member and positioned to activate said safety switch when the tool is moved into engagement with a workpiece.

34. The tool set forth in claim 26, wherein said drive housing subassembly includes a pair of outwardly extending bosses positioned on opposite sides of said bearing sleeve, and a retainer plate positioned around said bearing sleeve outside said second member and secured to said bosses.

35. The tool set forth in claim 26, which includes a shaft extending through said one end of said first and second members, eccentric means interconnecting said first member and said shaft so that rotation of said shaft adjusts the spacing between said idler wheel and said flywheel independently of said toggle mechanism, and pawl and ratchet means for restraining said shaft from rotation when it has been adjusted to a desired position.

36. The tool set forth in claim 35, wherein said shaft extends through a slot in said housing, and an adjustment knob is positioned on the end of said shaft outside said housing to facilitate adjustment of the spacing between said idler wheel and said flywheel to an optimum value.

37. The tool set forth in claim 35, wherein said shaft is journalled for rotation in said one end of said first member and said eccentric means comprises a shoulder on said shaft which is eccentric with respect to the axis of said shaft, said shoulder being positioned in a corresponding opening in said one end of said second member so that rotation of said shaft moves said one end of said second member relative to said one end of said first member.

38. The tool set forth in claim 35, wherein said pawl and ratchet means comprises a pair of discs positioned on said shaft and having cooperating detent means on the opposing faces thereof, means connecting one of said discs to said second member to prevent said one disc from rotating, means connecting the other disc to said shaft for rotation therewith, and means for urging said other disc into engagement with said one disc with a substantial force which must be overcome to rotate said shaft.

39. The tool set forth in claim 38, wherein said one disc has a single radially extending ridge and said other disc has a series of radially extending grooves into one of which said ridge is held by said urging member.

40. The tool set forthin claim 38, wherein said urging means comprises a coil spring coaxial with said shaft and engaging said other disc.

41. A tool for driving fasteners of the type having a housing, a ram mounted for reciprocation between an upper and a lower position and a flywheel selectively engaging said ram to drive said ram from said upper position to said lower position, and a removable cartridge for supporting said ram between said housing and returning said ram to said upper position after it is driven downwardly by said flywheel, said cartridge comprising:

a pair of opposed support members of plastic material forming a portion of said removable cartridge for reciprocably supporting said ram member each having upper and lower bumper portions for limiting the upward and lowerward travel, respectively, of said ram, said upper and lower bumper portions of each support being connected by integral side wall portions of said plastic material;

first and second pairs of pins positioned in apertures in the opposed faces of said supports, one pair of pins being located in the upper portion of said supports and the other pair being located in the bottom portion of said supports, said pins acting to space said opposed faces of said supports apart by a predetermined amount;

a pulley rotatably mounted on each of said first and second pairs of pins between said opposed faces of said supports; and an elastic cord resiliently supporting said ram in said upper position and extending around each of said pulleys, the ends of said cord being connected to said supports at points intermediate the length of said side wall portions thereof.

42. A tool as set forth in claim 41, wherein said housing includes an opening for removal of said cartridge, and a cover slidably connected in said housing, said cover normally closing said opening and being slidable by an amount sufficient to permit removal of said cartridge from said housing.

43. A tool as set forth in claim 42, which includes means for limiting the sliding movement of said cover to said amount so that said cover cannot be completely removed from said housing.

* * * * *